US010456641B2

(12) United States Patent
Nivanh et al.

(10) Patent No.: US 10,456,641 B2
(45) **Date of Patent: *Oct. 29, 2019**

(54) WEIGHT MEMBER FOR A GOLF CLUB HEAD

(71) Applicant: DUNLOP SPORTS CO. LTD., Kobe-shi, Hyogo (JP)

(72) Inventors: Dan S. Nivanh, Long Beach, CA (US); Nathaniel J. Radcliffe, Huntington Beach, CA (US); Jimmy H. Kuan, West Covina, CA (US)

(73) Assignee: SRI SPROTS LIMITED, Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/038,500

(22) Filed: Jul. 18, 2018

(65) Prior Publication Data

US 2018/0318679 A1 Nov. 8, 2018

Related U.S. Application Data

(63) Continuation of application No. 15/415,382, filed on Jan. 25, 2017, now Pat. No. 10,052,537, which is a (Continued)

(51) Int. Cl.
*A63B 53/00* (2015.01)
*A63B 60/00* (2015.01)
(Continued)

(52) U.S. Cl.
CPC ..... *A63B 60/00* (2015.10); *A63B 53/04* (2013.01); *A63B 53/0466* (2013.01);
(Continued)

(58) Field of Classification Search
CPC ..... A63B 53/04; A63B 53/0466; A63B 53/06; A63B 53/0487; A63B 53/047; A63B 2053/0491
See application file for complete search history.

(56) References Cited

U.S. PATENT DOCUMENTS 1,133,129 A 3/1915 Govan
1,167,106 A 1/1916 Palmer
(Continued)

FOREIGN PATENT DOCUMENTS

GB 2133295 A 7/1984
JP H10-137374 A 5/1998
(Continued)

OTHER PUBLICATIONS

Feb. 19, 2016 Office Action issued in U.S. Appl. No. 13/215,809.
(Continued)

*Primary Examiner* — John E Simms, Jr.
(74) *Attorney, Agent, or Firm* — Oliff PLC

(57) ABSTRACT

A weight member for removable attachment to a weight port of a golf club head is provided. The weight member comprises a head that has a tool mating port for operatively receiving a portion of a fastening tool. The weight member further comprises a shaft that is associated with the head such that the shaft terminates at an end surface. The shaft has a threaded external surface and a non-threaded internal bore that extends from the end surface.

17 Claims, 7 Drawing Sheets

Related U.S. Application Data continuation of application No. 13/215,809, filed on Aug. 23, 2011, now Pat. No. 9,573,027.

(51) Int. Cl.
*A63B 53/06* (2015.01)
*A63B 53/04* (2015.01)

(52) U.S. Cl.
CPC ..... *A63B 53/06* (2013.01); *A63B 53/047* (2013.01); *A63B 53/0487* (2013.01); *A63B 2053/0408* (2013.01); *A63B 2053/0433* (2013.01); *A63B 2053/0491* (2013.01); *Y10T 29/49* (2015.01)

(56) References Cited

U.S. PATENT DOCUMENTS 1,518,316 A 12/1924 Ellingham
1,538,312 A 5/1925 Beat
1,840,924 A 1/1932 Tucker
2,198,981 A 4/1940 Sullivan
2,460,445 A 2/1949 Bigler
3,212,783 A 10/1965 Bradley et al.
3,466,047 A 9/1969 Rodia et al.
3,610,630 A 10/1971 Glover
3,652,094 A 3/1972 Glover
3,692,306 A 9/1972 Glover
3,976,299 A 8/1976 Lawrence et al.
3,979,122 A 9/1976 Belmont
3,979,123 A 9/1976 Belmont
4,008,896 A 2/1977 Gordos
4,213,613 A 7/1980 Nygren
4,325,553 A 4/1982 Taylor
4,326,326 A 4/1982 MacDonald
4,411,430 A 10/1983 Dian
4,607,846 A 8/1986 Perkins
4,655,459 A 4/1987 Antonious
4,730,830 A 3/1988 Tilley
4,754,977 A 7/1988 Sahm
4,795,159 A 1/1989 Nagamoto
4,828,266 A 5/1989 Tunstall
4,867,458 A 9/1989 Sumikawa et al.
4,869,507 A 9/1989 Sahm
4,872,684 A 10/1989 Dippel
4,895,371 A 1/1990 Bushner
4,962,932 A 10/1990 Anderson
5,385,348 A 1/1995 Wargo
5,421,577 A 6/1995 Kobayashi
5,431,401 A 7/1995 Smith
5,439,222 A 8/1995 Kranenberg
5,447,309 A 9/1995 Vincent
D368,504 S 4/1996 Sommerhauser
5,518,243 A 5/1996 Redman
5,533,725 A 7/1996 Reynolds, Jr.
5,571,053 A 11/1996 Lane
5,629,475 A 5/1997 Chastonay
5,688,189 A 11/1997 Bland
5,769,736 A 6/1998 Sato
5,776,011 A 7/1998 Su et al.
5,795,239 A 8/1998 Lin et al.
5,795,255 A 8/1998 Hooper
5,911,638 A 6/1999 Parente et al.
5,924,938 A 7/1999 Hines
5,947,840 A 9/1999 Ryan
6,015,354 A 1/2000 Ahn et al.
6,059,669 A 5/2000 Pearce
6,089,994 A 7/2000 Sun
6,149,533 A 11/2000 Finn
6,277,032 B1 8/2001 Smith
6,290,607 B1 9/2001 Gilbert et al.
6,348,014 B1 2/2002 Chiu
6,482,104 B1 11/2002 Gilbert
6,514,154 B1 2/2003 Finn
6,638,181 B1 10/2003 Norman, III
6,773,360 B2 8/2004 Willett et al.
6,773,361 B1 8/2004 Lee
6,860,819 B2 3/2005 Gilbert
6,896,625 B2 5/2005 Grace
6,974,394 B1 12/2005 Tang et al.
6,991,558 B2 1/2006 Beach et al.
D515,165 S 2/2006 Zimmerman et al.
D516,656 S 3/2006 Hoffman et al.
7,018,304 B2 3/2006 Bradford
7,029,404 B2 4/2006 Lu
7,108,609 B2 9/2006 Stites et al.
7,121,956 B2 10/2006 Lo
7,147,576 B2 12/2006 Imamoto et al.
7,166,040 B2 1/2007 Hoffman et al.
7,186,190 B1 3/2007 Beach et al.
7,195,565 B2 3/2007 White et al.
7,198,575 B2 4/2007 Beach et al.
7,223,180 B2 5/2007 Willett et al.
7,232,381 B2 6/2007 Imamoto et al.
7,244,191 B2 7/2007 Tang et al.
7,273,423 B2 9/2007 Imamoto
7,281,991 B2 10/2007 Gilbert et al.
7,294,065 B2 11/2007 Liang et al.
7,297,073 B2 11/2007 Jung
7,326,121 B2 2/2008 Roake
D565,143 S 3/2008 Wilson
7,351,161 B2 4/2008 Beach
7,354,355 B2 4/2008 Tavares et al.
7,396,295 B1 7/2008 Frame et al.
7,407,447 B2 8/2008 Beach et al.
7,410,425 B2 8/2008 Willett et al.
7,410,426 B2 8/2008 Willett et al.
7,410,427 B2 8/2008 Imamoto et al.
7,419,441 B2 9/2008 Hoffman et al.
7,431,660 B2 10/2008 Hasegawa
7,442,129 B2 10/2008 Bardha
7,448,963 B2 11/2008 Beach et al.
7,452,285 B2 11/2008 Chao et al.
7,455,600 B2 11/2008 Imamoto et al.
7,462,110 B2 12/2008 Yamamoto
7,510,484 B2 3/2009 Tavares et al.
7,530,901 B2 5/2009 Imamoto et al.
7,530,903 B2 5/2009 Imamoto et al.
7,530,904 B2 5/2009 Beach et al.
7,540,811 B2 6/2009 Beach et al.
7,563,172 B2 7/2009 Mansfield
7,566,276 B2 7/2009 Billings
7,568,985 B2 8/2009 Beach et al.
7,572,193 B2 8/2009 Yokota
7,572,194 B2 8/2009 Yamamoto
7,575,523 B2 8/2009 Yokota
7,578,753 B2 8/2009 Beach et al.
7,588,501 B2 9/2009 Williams et al.
7,588,502 B2 9/2009 Nishino
7,591,738 B2 9/2009 Beach et al.
7,611,424 B2 11/2009 Nagai et al.
7,611,425 B2 11/2009 Yeh
7,621,823 B2 11/2009 Beach et al.
7,628,707 B2 12/2009 Beach et al.
7,628,711 B2 12/2009 Akinori et al.
7,632,193 B2 12/2009 Thielen
7,632,194 B2 12/2009 Beach et al.
7,648,425 B2 1/2010 Wahl et al.
RE41,116 E 2/2010 Zimmerman et al.
7,670,235 B2 3/2010 Lo
7,713,142 B2 5/2010 Hoffman et al.
7,717,804 B2 5/2010 Beach et al.
7,717,805 B2 5/2010 Beach et al.
7,722,478 B2 5/2010 Ebner
7,744,484 B1 6/2010 Chao
7,753,806 B2 7/2010 Beach et al.
7,771,290 B2 8/2010 Bezilla et al.
7,771,291 B1 8/2010 Willett et al.
D624,140 S 9/2010 Hicks
7,806,781 B2 10/2010 Imamoto
7,815,520 B2 10/2010 Frame et al.
7,824,277 B2 11/2010 Bennett et al.
7,824,280 B2 11/2010 Yokota
7,846,041 B2 12/2010 Beach et al.
7,887,434 B2 2/2011 Beach et al.

(56) References Cited

U.S. PATENT DOCUMENTS

| | | | | |
|---|---|---|---|---|
| 7,927,231 | B2 | 4/2011 | Sato et al. | |
| 8,177,663 | B2 | 5/2012 | Tucker, Sr. et al. | |
| 8,202,175 | B2 | 6/2012 | Ban | |
| 8,753,227 | B1 * | 6/2014 | Cackett | F16B 35/06 473/335 |
| 9,573,027 | B2 * | 2/2017 | Nivanh | A63B 53/06 |
| 10,052,537 | B2 * | 8/2018 | Nivanh | A63B 53/06 |
| 2001/0049310 | A1 | 12/2001 | Cheng et al. | |
| 2002/0137576 | A1 | 9/2002 | Dammen | |
| 2003/0100380 | A1 | 5/2003 | D'Eath | |
| 2003/0148818 | A1 | 8/2003 | Myrhum et al. | |
| 2004/0242343 | A1 | 12/2004 | Chao et al. | |
| 2005/0101408 | A1 | 5/2005 | Sanchez et al. | |
| 2005/0159239 | A1 | 7/2005 | Imamoto et al. | |
| 2005/0277485 | A1 | 12/2005 | Hou et al. | |
| 2006/0030420 | A1 * | 2/2006 | Roake | A63B 53/065 473/251 |
| 2006/0058112 | A1 | 3/2006 | Haralason et al. | |
| 2006/0094533 | A1 | 5/2006 | Warren et al. | |
| 2006/0100029 | A1 * | 5/2006 | Lo | A63B 53/0466 473/338 |
| 2006/0142095 | A1 | 6/2006 | Glickman | |
| 2006/0199666 | A1 | 9/2006 | De La Cruz | |
| 2006/0223649 | A1 | 10/2006 | Rife | |
| 2006/0240905 | A1 | 10/2006 | Haney et al. | |
| 2006/0240907 | A1 | 10/2006 | Latiri | |
| 2007/0004534 | A1 | 1/2007 | Lee et al. | |
| 2007/0021235 | A1 | 1/2007 | Jung | |
| 2007/0105646 | A1 | 5/2007 | Beach et al. | |
| 2007/0117652 | A1 | 5/2007 | Beach et al. | |
| 2007/0129163 | A1 | 6/2007 | Solari | |
| 2007/0149315 | A1 | 6/2007 | Bennett et al. | |
| 2007/0155529 | A1 | 7/2007 | Voges | |
| 2007/0161433 | A1 | 7/2007 | Yokota | |
| 2007/0178988 | A1 | 8/2007 | Tavares et al. | |
| 2007/0207875 | A1 | 9/2007 | Kuan et al. | |
| 2007/0243943 | A1 | 10/2007 | Inouye et al. | |
| 2007/0249432 | A1 | 10/2007 | Wu | |
| 2008/0009366 | A1 | 1/2008 | Lo | |
| 2008/0045353 | A1 * | 2/2008 | Lo | A63B 53/04 473/337 |
| 2008/0045354 | A1 | 2/2008 | Drew | |
| 2009/0048035 | A1 | 2/2009 | Stites et al. | |
| 2009/0111606 | A1 | 4/2009 | Bardha | |
| 2009/0247319 | A1 | 10/2009 | Billings | |
| 2009/0258725 | A1 | 10/2009 | Jones | |
| 2009/0286611 | A1 | 11/2009 | Beach et al. | |
| 2009/0298611 | A1 | 12/2009 | Bezilla et al. | |
| 2009/0298612 | A1 | 12/2009 | Knutson et al. | |
| 2010/0048325 | A1 | 2/2010 | Tanimoto | |
| 2010/0075774 | A1 | 3/2010 | Ban | |
| 2010/0113177 | A1 | 5/2010 | Bardha | |
| 2010/0113184 | A1 | 5/2010 | Kuan et al. | |
| 2010/0137073 | A1 | 6/2010 | Stites et al. | |
| 2010/0144461 | A1 | 6/2010 | Ban | |
| 2010/0167837 | A1 | 7/2010 | Ban | |
| 2010/0184527 | A1 | 7/2010 | Demkowski et al. | |
| 2010/0197424 | A1 | 8/2010 | Beach et al. | |
| 2010/0222153 | A1 | 9/2010 | Treadwell | |
| 2010/0255922 | A1 | 10/2010 | Lueders | |
| 2010/0304887 | A1 | 12/2010 | Bennett et al. | |
| 2010/0311520 | A1 | 12/2010 | Bezilla et al. | |
| 2010/0323815 | A1 | 12/2010 | Bezilla et al. | |
| 2010/0331104 | A1 | 12/2010 | Renna | |
| 2011/0021287 | A1 * | 1/2011 | Tucker, Sr. | A63B 53/065 473/334 |
| 2011/0028238 | A1 | 2/2011 | Boyd et al. | |
| 2011/0039632 | A1 | 2/2011 | Bennett et al. | |
| 2011/0118042 | A1 | 5/2011 | Ramsauer | |
| 2011/0124432 | A1 | 5/2011 | Oldknow et al. | |
| 2011/0124433 | A1 | 5/2011 | Boyd et al. | |
| 2014/0243110 | A1 | 8/2014 | Cackett et al. | |
| 2015/0031474 | A1 | 1/2015 | Franklin et al. | |

FOREIGN PATENT DOCUMENTS

| | | | |
|---|---|---|---|
| JP | H10-234902 | A | 9/1998 |
| JP | H10-248964 | A | 9/1998 |
| JP | H10-277187 | A | 10/1998 |
| JP | 2003-236025 | A | 8/2003 |
| JP | 2006-081862 | A | 3/2006 |
| JP | 2006-101918 | A | 4/2006 |
| JP | 2006-187489 | A | 7/2006 |
| JP | 2011-125623 | A | 6/2011 |
| WO | 9215374 | A1 | 9/1992 |
| WO | 2004/009187 | A1 | 1/2004 |

OTHER PUBLICATIONS

Oct. 25, 2016 Notice of Allowance issued in U.S. Appl. No. 13/215,809.
Jun. 13, 2016 Office Action issued in U.S. Appl. No. 13/215,809.
Jun. 3, 2015 Office Action issued in U.S. Appl. No. 13/215,809.
Oct. 3, 2014 Office Action issued in U.S. Appl. No. 13/215,809.
Jun. 23, 2014 Notice of Allowance issued in U.S. Appl. No. 13/215,809.
Feb. 21, 2014 Office Action issued in U.S. Appl. No. 13/215,809.
May 20, 2013 Office Action issued in U.S. Appl. No. 13/215,809.
Oct. 16, 2012 Office Action issued in U.S. Appl. No. 13/215,809.
Sep. 28, 2017 Office Action issued in U.S. Appl. No. 15/415,382.
Apr. 18, 2018 Notice of Allowance issued in U.S. Appl. No. 15/415,382.

* cited by examiner

WEIGHT MEMBER FOR A GOLF CLUB HEAD

CROSS-REFERENCE TO RELATED APPLICATIONS

This application is a continuation of U.S. patent application Ser. No. 15/415,382, filed Jan. 25, 2017, which is a continuation of U.S. patent application Ser. No. 13/215,809, filed Aug. 23, 2011, the subject matter of which is incorporated herein by reference in its entirety.

COPYRIGHT AUTHORIZATION

The disclosure below may be subject to copyright protection. The copyright owner has no objection to the facsimile reproduction by any one of the documents containing this disclosure, as they appear in the Patent and Trademark Office records, but otherwise reserves all applicable copyrights.

BACKGROUND OF THE INVENTION

Golf clubs of all types generally have a golf club head, a shaft and a grip. The golf club has inherent mass properties such as a center of gravity location and mass moments of inertia that critically affect the golf club's performance. The center-of-gravity location and the mass moments of inertia of a golf club are a function of at least the weight and geometry of the golf club head, the weight, length and shape of the shaft, and the weight and geometry of the grip.

Golf club heads are often adapted to be customized, for example, by having interchangeable parts such as sole plates, face plates, and adapted to fit any of a variety of shafts and grips. However, modifications to a club head, e.g. substitution of a shaft having a different length, generally affect the mass properties of the club head in an unintended manner (e.g. change the swingweight of the golf club). Thus, conventional customizable club heads that do not provide means to adjust such mass properties are limited in their ability to be optimized for a wide range of golfers.

SUMMARY

Certain embodiments of the present invention, in one or more aspects thereof, may advantageously comprise one or more weight members for effecting a change in the mass moments of inertia, center-of-gravity, and/or the swing weight of a golf club.

According to various embodiments, a weight member for removable attachment to a weight port of a golf club head comprises a head that has a tool mating port, or socket, for operatively receiving a portion of a fastening tool. The weight member also comprises a shaft associated with the head that terminates at an end surface. The shaft has a threaded external surface and a non-threaded internal bore extending from the end surface.

According to various embodiments, a kit of weights for removable and interchangeable attachment to a weight port of a golf club head includes a first weight and a second weight. The first weight comprises a first head that has a first head diameter and a first head end surface. The first weight also comprises a first shaft that has a first shaft end surface opposite the first head end surface, a first shaft diameter, and a first shaft length. The first weight further comprises a first internal bore extending from one of the first head end surface and the first shaft end surface, the first internal bore having a first internal bore depth. The second weight comprises a second head that has a second head diameter and a second head end surface. The second weight also comprises a second shaft that has a second shaft end surface opposite the second head end surface, a second shaft diameter that is substantially equal to the first shaft diameter, and a second shaft length. The second weight further comprises a second internal bore extending from one of the second head end surface and the second shaft end surface, the second internal bore having a second internal bore depth that is different from the first internal bore depth.

According to various embodiments, a kit of weights for removable and interchangeable attachment to a weight port of a golf club head includes a first weight and a second weight. The first weight comprises a first head that has a first head end surface. The first weight also comprises a first shaft that has a first shaft end surface opposite the first head end surface, a first shaft diameter, and a first shaft length. The first weight further comprises an internal bore extending from one of the first head end surface and the first shaft end surface. The first weight additionally comprises a first overall length and a first mass. The second weight comprises a second head. The second weight also comprises a second shaft that has a second shaft diameter that is substantially equal to the first shaft diameter, and a second shaft length. The second weight further comprises a second overall length such that a first ratio of the first overall length to the second overall length is no less than 0.85. The second weight additionally comprises a second mass such that a second ratio of the first mass to the second mass is no greater than 0.50.

According to various embodiments, a method of manufacturing a kit of weights for removable and interchangeable association with a weight port of a golf club head comprises providing a first weight by forming a first intermediate body having a first head and a first shaft associated with the first head and forming a first internal bore by removing a first mass from the first intermediate body. The method further comprises providing a second weight by forming a second intermediate body having a second head and a second shaft associated with the second head and forming a second internal bore by removing a second mass from the second intermediate body, the second mass being different from the first mass. The first weight includes a first shaft length and a first shaft diameter. The second weight includes a second shaft length and a second shaft diameter that is substantially equal to the first shaft diameter.

These and other features and advantages of the golf club head according to the invention in its various aspects, as provided by one or more of the various examples described in detail below, will become apparent after consideration of the ensuing description, the accompanying drawings, and the appended claims. The accompanying drawings are for illustrative purposes only and are not intended to limit the scope of the present invention.

BRIEF DESCRIPTION OF THE DRAWINGS

The present invention, in one or more aspects thereof, is illustrated by way of example and not by way of limitation, in the figures of the accompanying drawings, where:

FIG. 1(*a*) is an exploded rear perspective view of a golf club head having a weight port and a weight member, according to one embodiment;

FIG. 3(*a*) is a cross-sectional view of a weight member illustrated in FIG. 3, according to one embodiment;

For purposes of illustration, these figures are not necessarily drawn to scale. In all the figures, same or similar elements are designated by the same reference numerals.

DETAILED DESCRIPTION

Representative examples of one or more novel and nonobvious aspects and features of the weight member according to the present invention, disclosed below, are not intended to be limiting in any manner. Furthermore, the various aspects and features of the present invention may be used alone or in a variety of novel and nonobvious combinations and subcombinations with one another. Unless otherwise indicated, all numbers expressing quantities, ratios, and numerical properties used in the specification and claims are to be understood as being modified in all instances by the term "about."

As mentioned, golf clubs of all types generally have a golf club head, a shaft and a grip. The golf club has a center of gravity location and mass moments of inertia that critically affect the golf club's performance. The center-of-gravity location and the mass moments of inertia of a golf club are a function of at least the weight and geometry of the golf club head, the weight, length and shape of the shaft, and the weight and geometry of the grip. Golf club heads are often adapted to be customized, for example, by having interchangeable parts such as sole plates, face plates, and adapted to fit any of a variety of shafts and grips. However, modifications to a club head, e.g. substitution of a shaft having a different length, generally affect the mass properties of the club head in an unintended manner (e.g. change the swingweight of the golf club).

Accordingly, the present invention, according to certain embodiments, is directed to one or more weight members that are selectable by a manufacturer and/or a user for installation in a golf club head for effecting a change in mass properties of a golf club, e.g. the mass moments of inertia, center of gravity location, and/or the swing weight of a golf club. Introducing one or more weight members into a golf club head at various locations within the golf club head has a number of advantages such as, but not limited to, enabling the manufacture of a customizable golf club head from a same master such that the golf club head is capable of assembly with a wide array of shafts and grips, and/or post-manufacture customization by a user, optionally with the use of simple tools. By affecting the mass properties of the golf club head based on user preference and/or performance specifications regarding various combinations of golf club heads, shafts and grips, the user's confidence in his shot making ability is increased. In addition, particularly in the case of correcting a swingweight, the use of interchangeable weight members, as opposed to conventional methods such as using "mouse glue," permits precise placement of weight in desirable locations, as opposed to uncontrolled weight placement.

Figure 1:
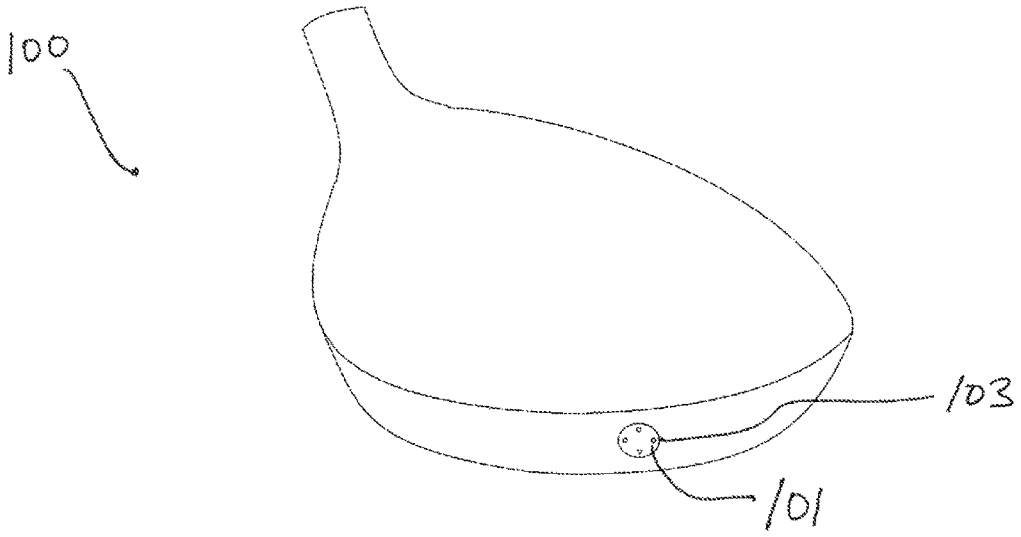
FIG. 1 is a rear perspective view of a golf club head having a weight member installed in a weight port, according to one embodiment.
Figure 1A:
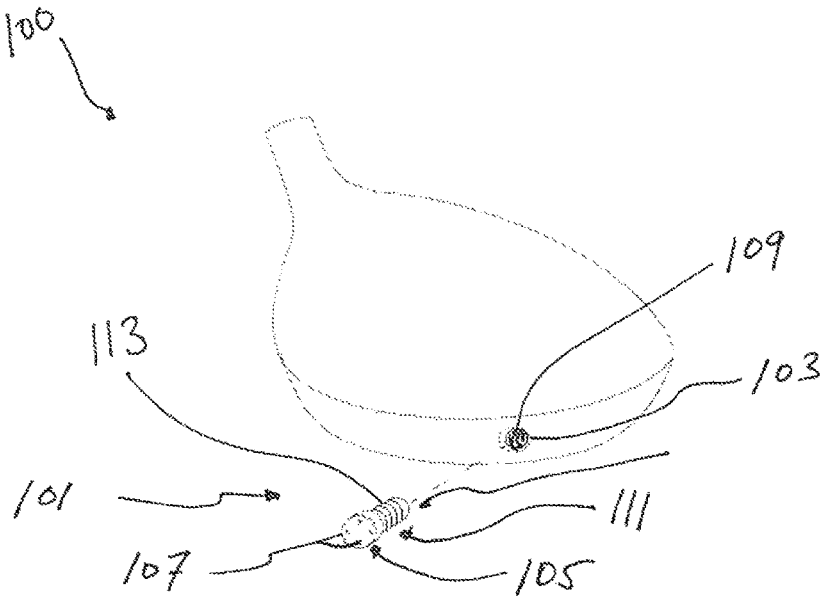
Figure 2A:
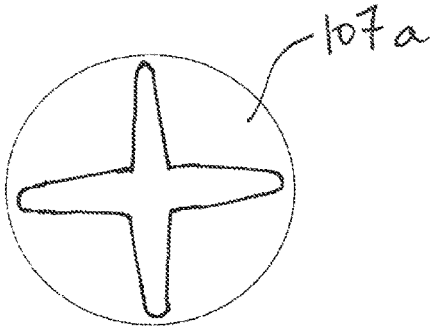
FIGS. 2(*a*)-2(*d*) are each top plan views of alternative embodiments of the weight member showing a socket portion in greater detail, according to various embodiments.
Figure 2B:
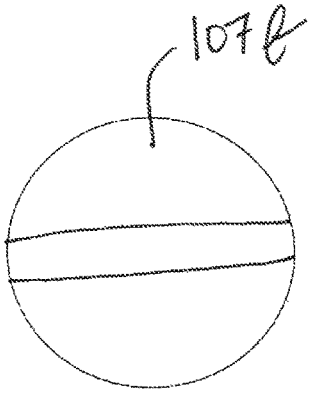
Figure 2C:
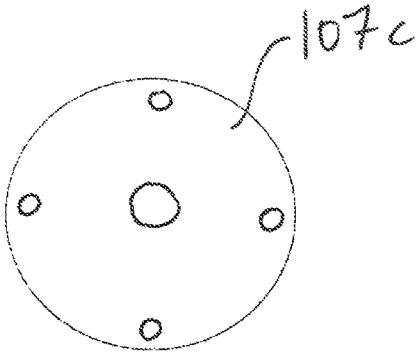
Figure 2D:
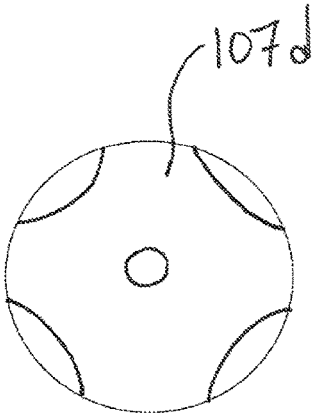

In one or more embodiments, and as depicted by way of example in FIGS. 1 through 1(*a*), a golf club head 100 comprises a wood-type golf club head. It is noted, however, that while the golf club head 100 is illustrated as a wood-type golf club head, the golf club head 100 may be any, e.g., an iron-type, putter-type, wood-type, hybrid-type, etc. It is further noted that while the golf club head 100 is illustrated as being a right-handed golf club head, any reference to any position on the golf club head 100 may be mirrored and applied to a left-handed golf club head.

FIG. 1 illustrates an assembly of the golf club head 100 and a weight member 101 that is removably secured in a weight port 103, according to one embodiment. The weight port 103 may be positioned anywhere on the golf club head 100, and may be singular or plural depending on the golf club head 100's design. The weight member 101 has a head 105. The head 105 has one or more tool mating ports, or sockets, 107. The tool mating ports 107 can be any type such as, but not limited to, a Phillips head, a flat head, a hex-head, a star head, a torx head, a four-prong wrench head, any proprietary head, etc. (as shown in FIG. 2(*a*) though 2(*d*), discussed below).

FIG. 1(*a*) illustrates an exploded view of the assembly illustrated in FIG. 1, according to various embodiments. The golf club head 100 and the weight member 101 are separated. A fastening tool (not shown) is used for securing and removing the weight member 101 to the club head 100. The weight port 103 is threaded with threads 109, enabling removable association with the weight member 101. The weight member 101 is illustrated as having a head 105 with socket 107 and a shaft 111. The shaft 111 terminates at an end surface and is threaded on the external surface of the shaft 111 with at least three threads 113. The threads 113 mate with the threads 109 when the weight member 101 is secured to the golf club head 100. The shaft 111, as discussed in more detail below, may or may not have a non-threaded internal bore extending from the end surface. The head portion 105 and the shaft 111 each have a respective outer diameter. In some embodiments, the outer diameter of the head portion 105 is greater than or equal to the outer diameter of the shaft 111. In some embodiments, the outer diameter of the head 105 is greater than the outer diameter of the shaft 111 such that, when secured to the club head 100, the head 105 abuts a shoulder portion of the weight port 103. In alternative embodiments, the weight member 101 is configured to be secured to the weight port 103 by interference fit, or any other mechanical interlocking device, adhesive, welding, brazing, or other material bonding process.

FIGS. 2(*a*) through 2(*d*) illustrate different types of sockets 107*a* through 107*d*, according to various embodiments. FIG. 2(*a*) illustrates a socket 107*a* that is a Phillips head-type port for mating with a tool that is, or is similar to, a Phillips head screwdriver.

FIG. 2(*b*) illustrates a socket 107*b* that is a flat head-type port for mating with a tool that is, or is similar to, a flat head screwdriver.

FIG. 2(*c*) illustrates a socket 107*c* that is a four prong head-type port for mating with a tool that is, or is similar to, a wrench or screw driver that has a set of male prongs that mate with the tool mating port 107*c*.

FIG. 2(*d*) illustrates a socket 107*d* that is a proprietary head-type port for mating with a tool that is specifically designed to mate with the socket 107*d*. The socket 107*d* may be of any shape, geometry or topography that may advantageously affect the installation of the weight member 101.

In various embodiments, the sockets 107*c* and 107*d*, for example, may be further configured to accommodate a bore (not shown) that extends entirely through the weight member 101 (as discussed below), or an internal bore that extends from an end surface of the head 105.

Figure 3:
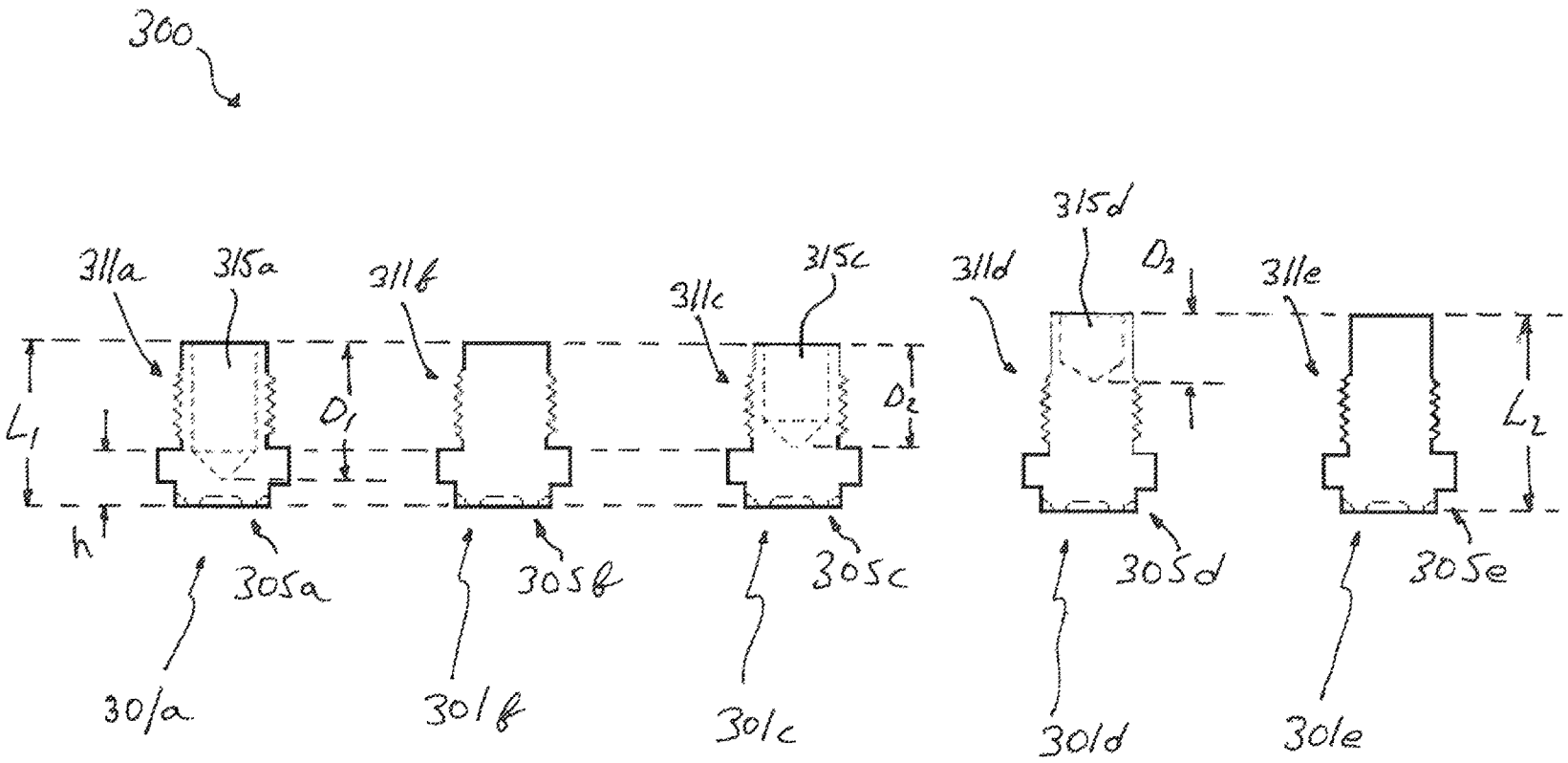
FIG. 3 is a front elevation view of a kit of weight members having internal bores through shafts of the weight members, according to one embodiment.
Figure 3A:
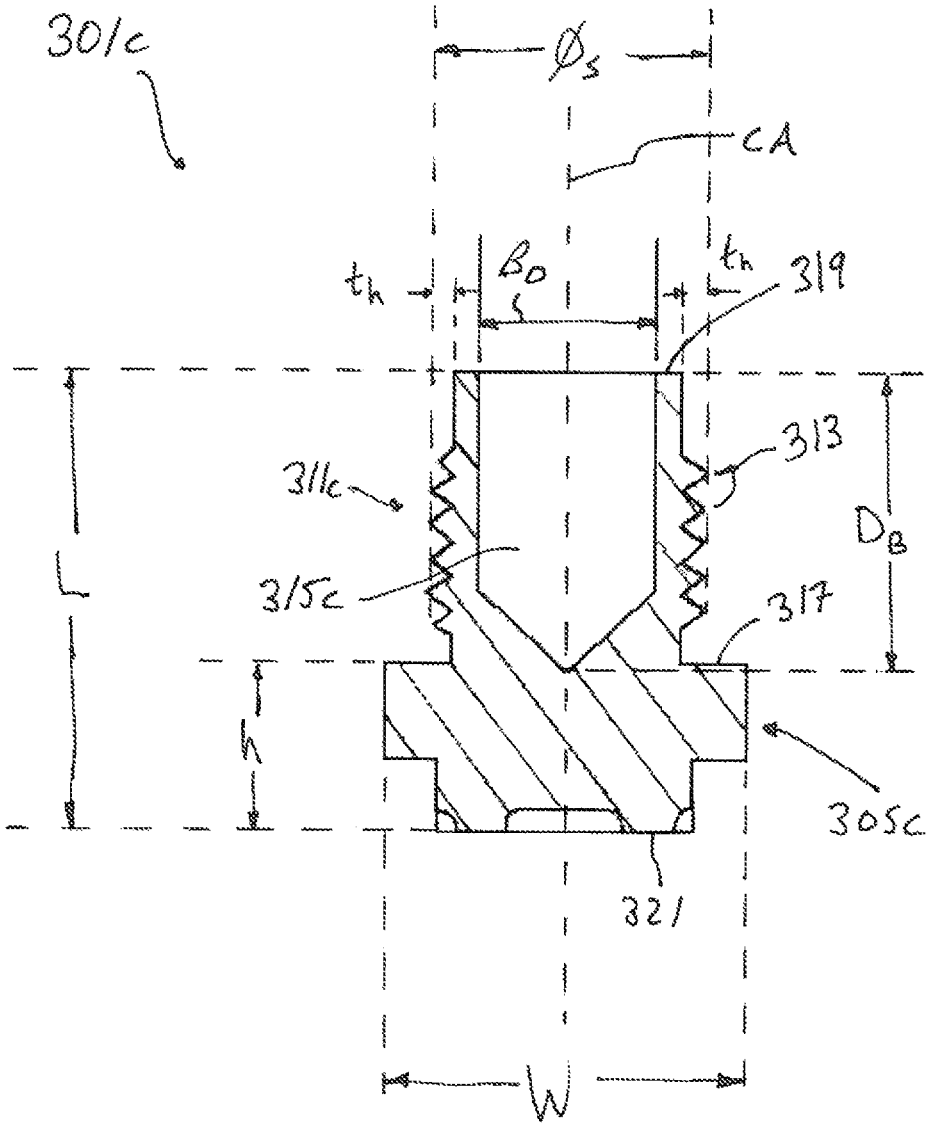

FIG. 3 illustrates a kit 300 of weight members 301*a* through 301*e* (collectively referred to as weight member(s) 301), according to one or more embodiments. The weight members 301 are adapted for interchangeable installation into the weight port 103 illustrated in FIGS. 1 and 1(*a*). Each of the weight members 301 have a head 305*a* through 305*e* (collectively referred to as head(s) 305). Each of the weight members 301 also have a shaft 311*a* through 311*e* (collectively referred to as shaft(s) 311) that each extend from, and adjoin with, the head 305. The shafts 311 are each of a substantially equal outer diameter that is sized to be removably and snugly securable within the weight port 103 discussed above. For example, in some embodiments, each weight member 301 of the kit 300 has similar thread geometry, e.g. threads per millimeter and pitch. The shafts 311 are also substantially equal in outer diameter to one another. The term "substantially" relates to a range of tolerances of the shaft diameter capable of enabling each of the weight member 301 to be snugly and removably secured to a specified threaded weight port, e.g. weight port 103, that has a specified inner diameter and thread geometry. Unless otherwise indicated, each of the kit embodiments discussed below preferably consist of weight members having shafts of substantially equal outer diameters.

Each of the weight members 301 of the kit 300 vary in mass from one another. In one embodiment, the kit 300 comprises weight members 301 that, when ordered from lowest in mass to highest in mass, the mass of the weight member 301 with the lowest mass is no greater than 7 g. In another embodiment, the mass of the weight member 301 with the lowest mass is no greater than 8 g. In a further embodiment, the mass of the weight member 301 with the lowest mass is no greater than 9 g.

In various embodiments, the weight members 301 of kit 300 differ in mass from each other by any amount such that the differences in mass are evenly distributed among the kit 300. In additional embodiments, the weight members 301 of kit 300 differ in mass from each other by at least 1 g such that the differences in mass are evenly distributed among the kit 300. In other embodiments, the weight members 301 of kit 300 differ in mass from each other by at least 2.5 g such that the differences in mass are evenly distributed among the kit 300. In another embodiment, the weight members 301 of kit 300 differ in mass from each other by at least 3 g such that the differences in mass are evenly distributed among the kit 300. In a further embodiment, the weight members 301 of kit 300 differ in mass from each other by any amount such that the differences in mass are unevenly distributed among the kit 300.

In other embodiments, the weight members 301 of kit 300 evenly or unevenly differ in mass from each other by any amount such that a ratio of a weight member 301 having a smaller mass than a weight member 301 having a larger mass is no greater than 0.50. In this embodiment, the kit 300 has at least one pair of weight members 301 having mass properties that would result in this ratio. It should be noted that while the kit 300 is illustrated as having five different weight members 301*a* through 301*e*, the kit may be comprised of any number of weight members no less than two. In one or more embodiments, weight member 301*a* has a mass of 7 g, weight member 301*b* has a mass of 10 g, weight member 301*c* has a mass of 13 g, weight member 305*d* has a mass of 16 g, and weight member 305*e* has a mass of 18.5 g.

In one or more embodiments, the variation in mass between weight members 301 that are part of the kit 300 is caused by factors such as, but not limited to, variations in lengths of shafts 311, variations in materials of the weight members 301, the presence of one or more bores in the weight member 301, the lack of a bore, the number of bores, the dimensions of the one or more bores, including a depth of any internal bore, or any combination thereof. For example, in some embodiments, the golf club head is attachable to one of a set of interchangeable shafts, each having a different shaft length. Preferably, the weight members of the kit are configured such that the masses of the weight members are incremented in linear relationship with the shaft lengths of each shaft of the set.

The weight members 301 each have an overall length. In some embodiments, the overall length of each of the weight members 301 that make up the kit 300 are substantially equal. In alternative embodiments, the weight members 301 vary in overall length. For example, in some such embodiments (as shown in FIG. 3), a head length h of each weight member is constant, but shaft lengths, e.g. $L_1$−h, vary between at least two weight members 301 of the kit 300. For example, the overall length L of weight members 301*a*, 301*b* and 301*c* is $L_1$ while the overall length L of weight members 301*d* and 301*e* is $L_2$. The length of the shaft 311 may be determined by subtracting h from L. For example, the length of the shaft 311*a* is equal to $L_1$−h, and the length of the shaft 301*d* is equal to $L_2$−h. In one or more embodiments, the overall length L is no less than 10 mm. In another embodiment, the overall length L is no less than 15 mm. In a further embodiment, the overall length L is between 15 mm and 20 mm.

It should be noted that the height of the head h, in certain embodiments, is variable among the weight members 301 of the kit 300. Altering the height of the head h also has an effect on the mass of the weight member 301, as well as the depth, for example, of the weight port 103.

In various embodiments, the kit 300 comprises at least two weight members 301 that each have an overall length L of differing values. For example, in the embodiment shown in FIG. 3, each of weight members 301*a*, 301*b*, and 301*c* include an overall length of $L_1$. Each of weight members 301*d* and 301*e* have an overall length of $L_2$, being different than $L_1$. In some embodiments, $L_2$ is greater than $L_1$. In some embodiments, a ratio of the overall lengths $L_1/L_2$ is no less than 0.75. In another embodiment, the ratio of the overall lengths $L_1/L_2$ in this embodiment is no less than 0.85. In a further embodiment, the ratio $L_1/L_2$ is between about 0.85 and about 0.96. The kit 300, however, may comprise any number of weight members 301 that relate to each other by any ratio of overall length. In one or more embodiments, for example, $L_1$ is equal to about 16.7 mm and $L_2$ is equal to about 17.65 mm.

In various embodiments, the weight members 301 are comprised of any combination of materials such as stainless steel, titanium, nickel, tungsten, other metal, and/or a polymer. In some embodiments, the composition of each weight member 301 varies thereby affecting the mass of the weight member 301 as the materials have different densities. For example, a weight member 301 comprised of steel (density ~7.85 g/cm$^3$) would have a density that was lower than a weight member comprised of tungsten-nickel (density ~14.0 g/cm$^3$). Therefore, a weight member 301 comprised of steel, and occupying the same space (volume) as a weight member 301 comprised of tungsten-nickel would have a lower mass than the weight member comprised of tungsten-nickel.

In various embodiments, the kit 300 comprises at least two weight members 301 that each have a density of differing values, the density of a second weight member 301 being greater than the density of a first weight member 301. In some embodiments, a ratio of the density of the second weight member 301 to the density of the first weight member 301 is no less than 0.20. In another embodiment, the ratio of densities is between about 0.25 and about 0.75. In a further embodiment, the ratio of densities is no less than 0.50. In one or more embodiments, referring to FIG. 3, weight members 305*a*, 305*b*, and 305*c* each comprise stainless steel and each have a density between about 6 g/cm$^3$ and about 10 g/cm$^3$, while weight members 305*d* and 305*e* each comprise a tungsten-nickel alloy having a density between about 12 g/cm$^3$ and about 16 g/cm$^3$.

In various embodiments, at least one of the weight members 301 has a bore. For example, as shown in FIG. 3, weight member 305*a* includes a bore 315*a*, weight member 305*c* includes a bore 315*c*, and weight member 305*d* includes a bore 315*d* (collectively referred to as bore(s) 315). Each of bores 315*a*, 315*c*, and 315*d* serve to displace a specified mass from their corresponding weight member 301*a*, 301*c* and 301*d*. The bores 315, as illustrated, are threadless and, in some embodiments, have a depth D that varies from one another such that the mass that is displaced from the corresponding weight member 301 is different from the other weight members 301. In alternative embodiments, the bores 315 may be threaded to accommodate additional members (not shown) configured to be installed within the bore 315. The additional members may be any of another weight member, a vibration damper, and the like. However, such threaded configuration generally increases manufacturing costs, and generates stress concentrations that adversely affect the structural integrity of the weight member 301. Alternatively to a threaded interior to the bore, a pop-in socket link may be configured within the bore 315 to accommodate the additional member.

In some embodiments, for example in the embodiment shown in FIG. 3, the bores 315*a*, 315*c*, and 315*d* are of the same diameter. In some such embodiments, the bore diameter is between about 4 mm and about 8 mm. In other such embodiments, the bore diameter is between about 6 mm and about 7 mm. In alternative embodiments, the bores 315 vary in diameter from one another and have the same or differing depths. In further embodiments, while the bore 315 is illustrated as being a single bore, any weight member 301 alternatively has multiple bores 315. The bores 315 are illustrated as having cone or bowl-shaped ends toward the head 305, but the bores 315 may also have flat-shaped ends (see FIG. 4). The bore depth D, in certain embodiments, may also be greater than, less than, or equal to the shaft length, L−h, of shaft 311. In other words, at least one weight member that includes a bore 315, the bore depth may extend into the head 305 as viewed in cross-section. For example, bore 315*a* extends at least partially into the head 305 of weight member 301*a*. In one or more embodiments, the bore depth D is no less than 3 mm. In other embodiments, the bore depth D is no less than 6 mm. In further embodiments, the bore depth D is no less than 9 mm.

In one or more embodiments, the bore depth D is compared to the shaft length L−h. The ratio of the bore depth to shaft length in this embodiment is no less than 0.15. In another embodiment, the ratio of bore depth to shaft length is no less than 0.20. In a further embodiment, the ratio of bore depth to shaft length is no less than 0.25.

In various embodiments, the kit 300 comprises at least a first and second weight member 301 that have bores with different depths D. For example, a first weight member 301*a* is shown in FIG. 3 having a first bore depth $D_1$ and a second weight member 301*d* is shown having a second bore with a depth $D_3$, the absolute value difference between the bore depths $D_1$ and $D_3$ being no less than 0.50 mm, for example. In another embodiment, such absolute value difference is no less than 1.00 mm. In a further embodiment, such absolute value difference is no less than 1.50 mm.

Alternatively, the weight member may not have a bore 315 that displaces mass, but rather the weight member is solid throughout such as weight members 301*b* and 301*e*.

The above-discussed embodiments can be combined to produce any number of variables that affect the mass of the weight member 301. Further, the weight members 301 may or may not have different masses based on the same types of variables or combinations of variables.

Table 1-1 is an example of how various combinations of materials, shaft lengths, and bore depths affect the mass of the weight members 301.

TABLE 1-1

| | Weight Member Data Mass (g) | | | | |
|---|---|---|---|---|---|
| | 7 g | 10 g | 13 g | 16 g | 18.5 g |
| Shaft Length (mm) | 10.80 | 10.80 | 10.80 | 11.76 | 11.76 |
| Head Length (mm) | 5.90 | 5.90 | 5.90 | 5.90 | 5.90 |
| Overall Length (mm) | 16.70 | 16.70 | 16.70 | 17.66 | 17.66 |
| Bore Depth (mm) | 13.94 | No Bore | 12.88 | 6.07 | No Bore |
| Bore Diameter (mm) | 6.5 | Not Applicable | 6.5 | 6.5 | Not applicable |
| Shaft Outer Diameter (mm) | 10 | 10 | 10 | 10 | 10 |
| Material | Steel | Steel | W—Ni | W—Ni | W—Ni |
| Density (g/cm$^3$) | 7.85 | 7.85 | 14 | 14 | 14 |

FIG. 3(*a*) is a front elevation view of a cross-section of weight member 301, according to one embodiment. Specifically, FIG. 3(*a*) illustrates, as an example, weight member 301*c*. The weight member 301*c* has a central axis CA that passes through the center of the weight member 301*c* in a manner that is perpendicular to an end surface 317 of the head 305*c* and a bottom surface, or shaft end surface, 319 of the weight member 301*c*. The head 305*c*, the shaft 311*c*, and the bore 315*c* are all illustrated as being coaxial with the central axis CA. Alternative embodiments, however, may provide one or more bores 315 that are not co-axial with the central axis CA.

The weight member 301*c* has a head surface 321 that is generally perpendicular to the central axis CA. The weight member 301*c* has an overall length L that is measured between the head surface 321 and the bottom surface 319. The length L, as discussed above, may vary among weight members 301 of the kit 300. In one embodiment, the overall length L is no less than 10 mm. In another embodiment, the overall length L is no less than 15 mm. In a further embodiment, the overall length L is no greater than 20 mm.

The head 305 has a height h that is measured from the head surface 321 to the end surface 317 along the central axis CA. The height h of the head is generally constant among each of the weight members 301*c* of the kit 300, but, in alternative embodiments, the height h can vary, for example to further increase the variance in mass of the weight member 301*c* from the lightest to the heaviest. The height h of the head 305*c* is no greater than 8 mm. In another embodiment, the height h of the head 305*c* is no greater than 6 mm. In a further embodiment, the height h of the head 305*c* is no greater than 4 mm.

The head 305*c* has a head outer diameter W that is no greater than 15 mm. In another embodiment, the head outer diameter W is no greater than 13 mm. In another embodiment, the head outer diameter W is no greater than 10 mm.

The shaft 311*c* has a shaft diameter $\Phi_S$ that is an overall thickness of the shaft 311*c* in the cross-sectional view, measured from the outer extents of the threaded portion of the shaft. The shaft diameter $\Phi_S$, as discussed above, is substantially equal to the diameter of the weight port 103, allowing for tolerances necessary for securable and removable association of the weight member 301*c* and the weight port 103. The shaft diameter $\Phi_S$ is less than or equal to the head outer diameter W. Accordingly, in one embodiment, the shaft diameter $\Phi_S$ is no greater than 15 mm. In another embodiment, the shaft diameter $\Phi_S$ is no greater than 13 mm. In a further embodiment, the shaft diameter $\Phi_S$ is no greater than 10 mm.

The threads 313 are formed along an external circumferential surface of the shaft 311. In one embodiment, the threaded external surface includes no less than three threads 313. In another embodiment, the threaded external surface includes no less than five threads 313. In a further embodiment, the threaded external surface includes no less than six threads 313. In an additional embodiment, the threaded external surface includes no less than 8 threads 313.

In embodiments, the number of threads 313 can also be referred to in terms of threads/mm. In one embodiment, the threads/mm of the threads 313 of any of the weight members 301 of the kit 300 ranges from 0.27-1.10 threads/mm. In another embodiment, the threads/mm of the threads 313 of any of the weight members 301 of the kit 300 ranges from 0.55-0.94 threads/mm. In a further embodiment, the threads/mm of the threads 313 of any of the weight members 301 of the kit 300 ranges from 0.62-0.84 threads/mm. In an additional embodiment, the threads/mm of the threads 313 of any of the weight members 301 of the kit 300 is about 0.79 threads/mm.

In embodiments, the threads 313 have a thread height $h_t$ that is measured between an outer circumferential surface of the shaft 311 and a tip of the thread 313 in a direction perpendicular to the central axis CA. In one embodiment, the thread height $h_t$ of the threads 313 of any of the weight members 301 of the kit 300 ranges from 0.50 mm-2 mm. In another embodiment, the thread height $h_t$ of the threads 313 of any of the weight members 301 of the kit 300 ranges from 0.70 mm-1.50 mm. In a further embodiment, the thread height $h_t$ of the threads 313 of any of the weight members 301 of the kit 300 ranges from 0.80 mm-1.10 mm. In an additional embodiment, the thread height $h_t$ of the threads 313 of any of the weight members 301 of the kit 300 is about 0.91 mm. In some embodiments, the thread count remains substantially constant for each weight member of the kit 300. Likewise, in some embodiments the number of threads per millimeter remains substantially constant for each weight member of the kit 300. Such configuration is advantage in reducing manufacturing costs and enabling interchangeability of each weight member of the kit with regards to a single weight port.

In embodiments, the bore 315 has a bore width in its cross-section that is generally a diameter $B_D$ in a case where the bore 315 is round. The bore width, like the bore depth D, may be varied from one weight member to another weight member, within the kit 300, to affect the mass of the weight member 301. In one embodiment, the bore width $B_D$ is about 6.35 mm and may be kept consistent among all of the weight members 301 of kit 300, or it may change to affect the mass of the weight members 301 of the kit 300. In another embodiment, the bore width $B_D$ ranges between 2 mm and 8 mm. In a further embodiment, the bore width ranges between 5 mm and 7 mm.

In various embodiments, the bore 315, as discussed above, is generally circular when viewed from an entry direction. The bore profile may alternatively be of any shape such as a square, rectangle, octagon, hexagon, any other polygon, or an ellipse or other arced or curved shape with or without straight lines or edges. In other embodiments, while the bore 315 is illustrated as having generally straight sides, the inside of the bore 315 may be stepped, ribbed, curved, angled beveled, etc. with respect to the central axis CA. In other words, in some embodiments, the bore profile varies along the central axis CA. In further embodiments, while the bore 315 is illustrated as generally having a uniform bore width $B_D$, from an opening to near its end, the opening may have a width that is greater than or less than the rest of bore 315. The sides of the bore 315 may also be concave, convex, or any combination thereof.

Figure 4:
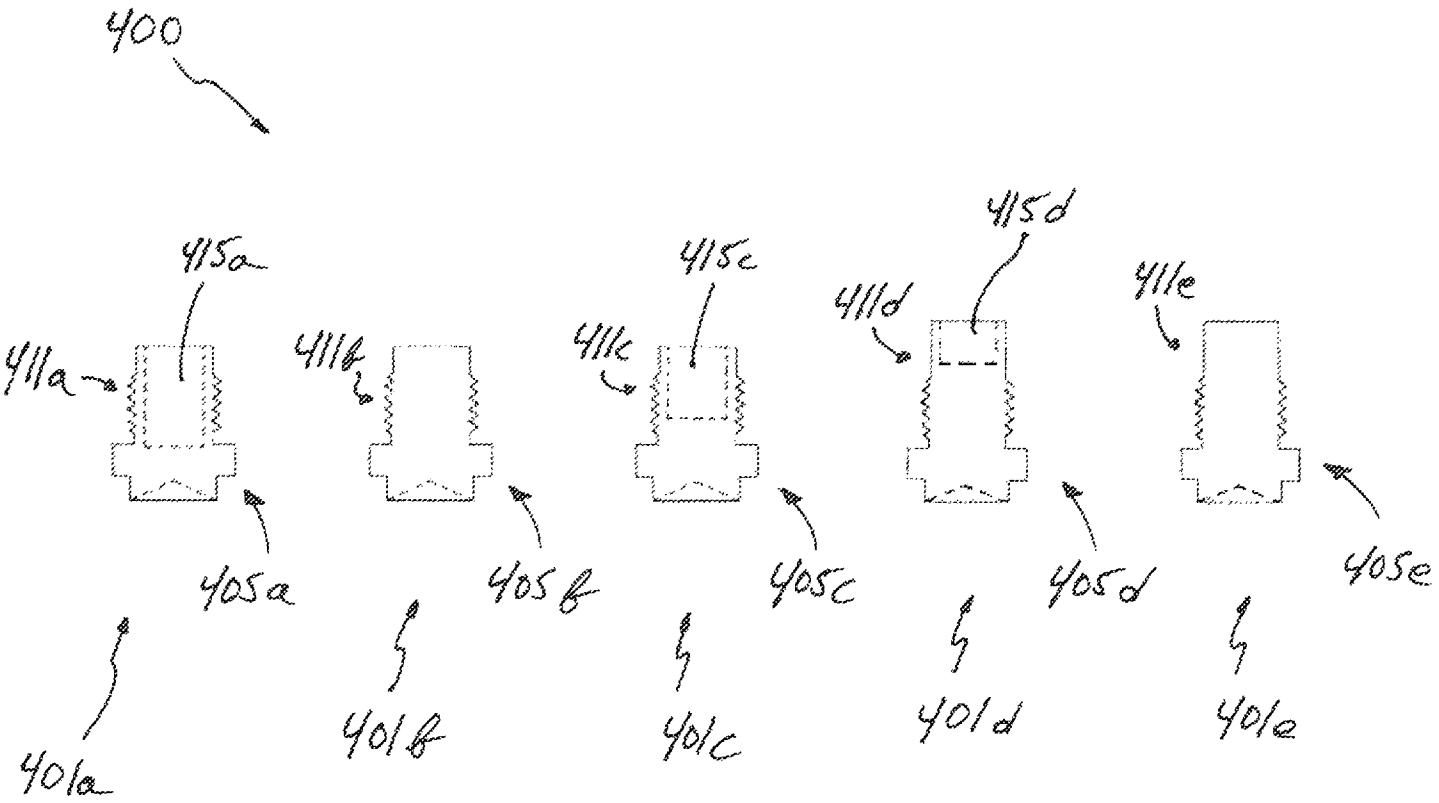
FIG. 4 is a front elevation view of a kit of weight members having flat-bottomed bores through shafts of the weight members, according to one embodiment.

FIG. 4 illustrates a kit 400 of weight members 401*a* through 401*e* (collectively referred to as weight member(s) 401), according to one embodiment. The weight members 401 are adapted for installation into the weight port 103 illustrated in FIGS. 1 and 1(*a*). Each of the weight members 401 have a requisite head 405*a* through 405*e* (collectively referred to as head(s) 405). Each of the weight members 401 have a requisite shaft 411*a* through 411*e* (collectively referred to as shaft(s) 411) that extend from the head 405 and are of a substantially equal outer diameter as that of an inner diameter of the weight port 103 discussed above. The shafts 411 are also substantially equal in outer diameter to one another. Again, the term "substantially" relates to a range of tolerances of the shaft diameter for which the weight member is able to be snugly and removably secured into the threaded weight port 103.

In various embodiments, the kit 400 is configured in like manner to the embodiments discussed above with reference to the kit 300, but the kit 400 specifically illustrates bores having flat-shaped ends. The weight members 401 have bores 415*a*, 415*c* or 415*d* (collectively referred to as bore(s) 415) that displace a specified mass from the weight members 401*a*, 401*c* and 401*d*, for example. The bores 415, as illustrated, are threadless and at least two vary in depth from one another such that the mass that is displaced from the corresponding weight member 401 is different from any of the other weight members 401. In embodiments, the bores 415 may be threaded to accommodate additional members (not shown) configured to be installed within the bore 415. The additional members may be any of another weight member, a vibration damper, and the like. Alternatively to a threaded interior to the bore, a pop-in socket link may be configured within the bore 415 to accommodate the additional member.

In other embodiments, the bores 415 vary in diameter from one another and may be of the same or differing depths. In further embodiments, while the bore 415 is illustrated as being a single bore, the weight member 401 alternatively has multiple bores 415. The bore depth, in certain embodiments, may also be greater than, less than, or equal to the shaft length L−h of shaft 311. In other words, the bore depth may extend into the head 405.

In various embodiments, the kit 400 comprises at least two weight members 401 that each have a bore depth of differing values, the absolute value difference between the bore depths of each of the weight members 401 being no less than 0.50 mm, for example. In another embodiment, the absolute value difference between bore depths is no less than 1.00 mm. In a further embodiment, the absolute value difference between bore depths is no less than 1.50 mm.

Alternatively, the weight member may not have a bore 415 that displaces mass, but rather the weight member is solid such as weight members 401*b* and 401*e*.

The above-discussed embodiments can be combined to produce any number of variables that affect the mass of the weight member 401. Further, the weight members 401 may or may not have different masses based on the same types of variables or combinations of variables.

Figure 5:
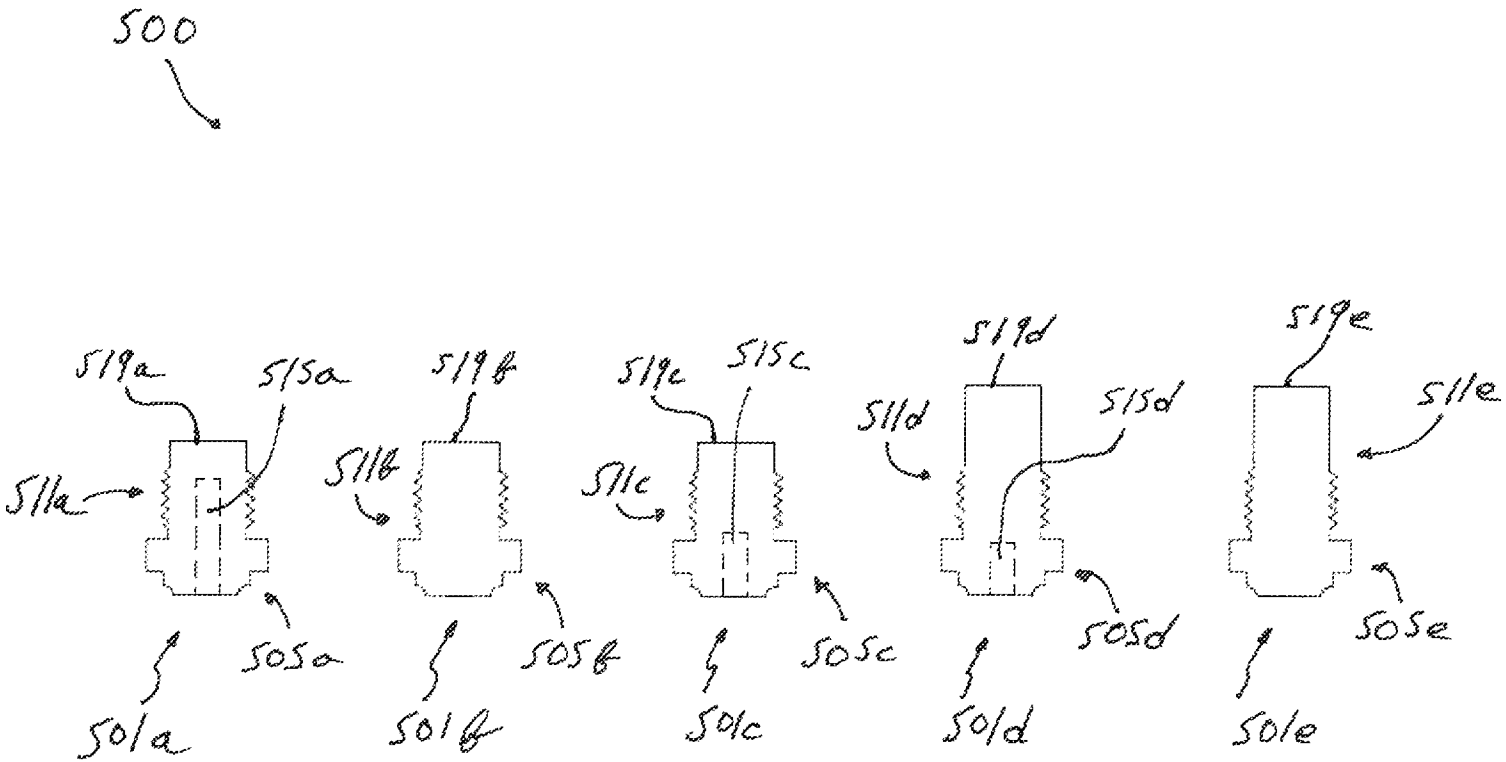
FIG. 5 is a front elevation view of a kit of weight members having bores that extend from heads of the weight members, according to one embodiment.

FIG. 5 illustrates a kit 500 of weight members 501*a* through 501*e* (collectively referred to as weight member(s) 501), according to one embodiment. The weight members 501 are adapted for installation into the weight port 103 illustrated in FIGS. 1 and 1(*a*). Each of the weight members 501 has a requisite head 505*a* through 505*e* (collectively referred to as head(s) 505). Each of the weight members 501 has a requisite shaft 511*a* through 511*e* (collectively referred to as shaft(s) 511) that extend from the head 505 and are of a substantially equal outer diameter as that of an inner diameter of the weight port 103 discussed above. The shafts 511 are also substantially equal in outer diameter to one another. Again, the term "substantially" relates to a range of tolerances of the shaft diameter for which the weight member is able to be snugly and removably secured into the threaded weight port 103.

In various embodiments, the kit 500 has many of the same features as those discussed above with reference to the kit 300, but the kit 500 specifically illustrates bores having flat-shaped ends and that extend from the head 505 rather than the bottom surface 519 of the weight member 501. Specifically, the weight members 501 have bores 515*a*, 515*c* or 515*d* (collectively referred to as bore(s) 515) that each displace a specified mass from the weight members 501*a*, 501*c* and 501*d*, for example. The bores 515, as illustrated, are threadless and all vary in depth from one another such that the mass that is displaced from one of the weight members 501 is different from at least one other weight member 501. In embodiments, the bores 515 may be threaded to accommodate additional members (not shown) configured to be installed within the bore 515. The additional members may be any of another weight member, a vibration damper, and the like. Alternatively to a threaded interior to the bore, a pop-in socket link may be configured within the bore 515 to accommodate the additional member.

In other embodiments, the bores 515 vary in diameter from one another and may be of the same or differing depths. In further embodiments, while the bore 515 is illustrated as being a single bore, the weight member 501 alternatively has multiple bores 515. The bore depth, in certain embodiments, may also be greater than, less than, or equal to the shaft length L−h of shaft 511. In other words, the bore depth, in some embodiments, and for at least one of the weight members 501, extends into the head 505.

In various embodiments, the kit 500 comprises at least two weight members 501 that each have a bore depth of differing values, the absolute value difference between the bore depths of at least two of the weight members 501 being no less than 0.50 mm, for example. In another embodiment, the absolute value difference between bore depths is no less than 1.00 mm. In a further embodiment, the absolute value difference between bore depths is no less than 1.50 mm. Alternatively, the weight member may not have a bore 515 that removes mass, but rather the weight member is solid such as weight members 501*b* and 501*e*. The above-discussed embodiments can be combined to produce any number of variables that affect the mass of the weight member 501. Further, the weight members 501 may or may not have different masses based on the same types of variables or combinations of variables.

Figure 6:
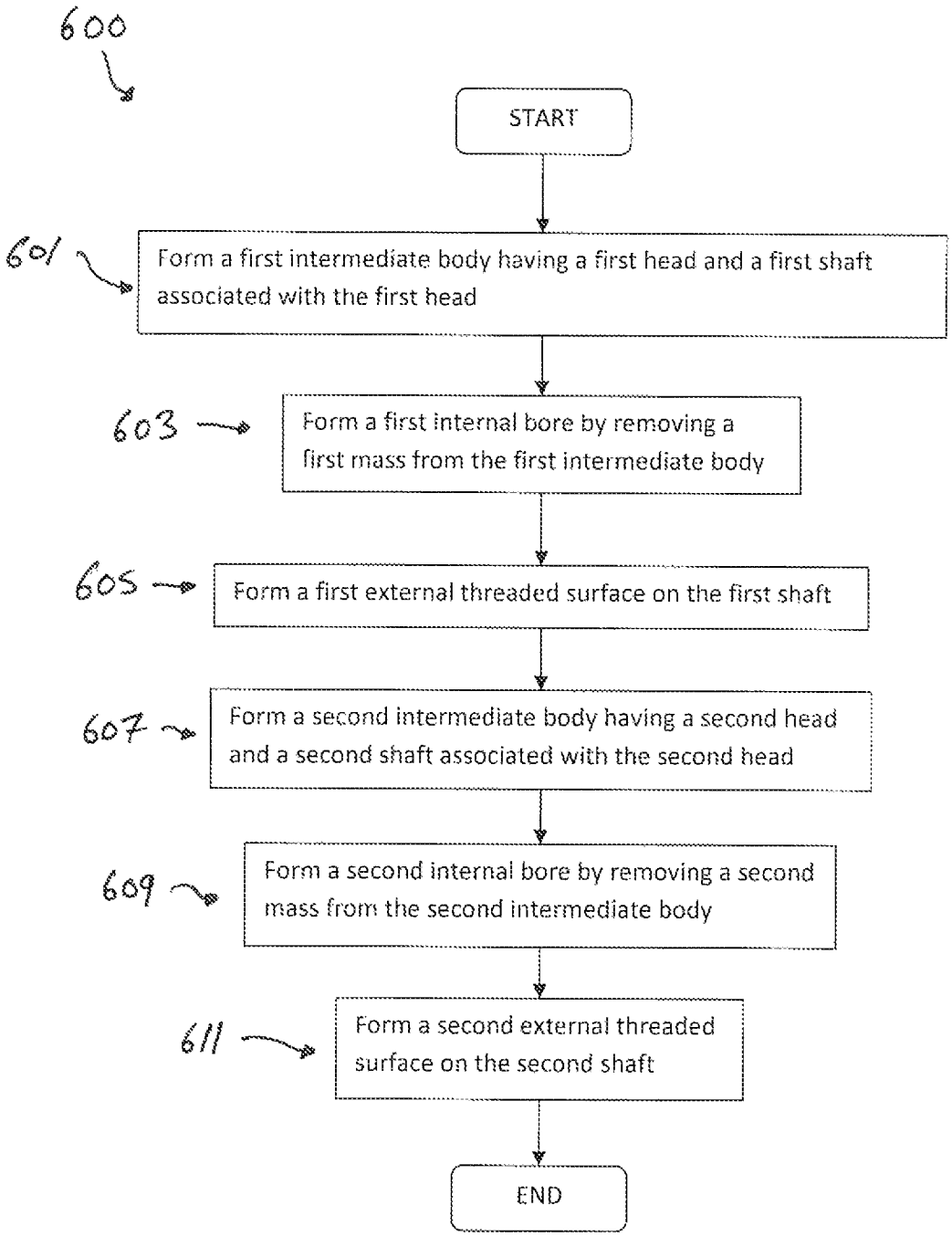
FIG. 6 is a flowchart diagram of a process for manufacturing a kit of weight members, according to one embodiment.

FIG. 6 illustrates a flowchart of a process 600 for manufacturing a kit of weights for removable and interchangeable association with a weight port of a golf club, e.g. golf club 100, according to any of the embodiments discussed above. The process 600 may be performed by using any manufacturing process such as, but not limited to, machining, milling, casting, molding, etc. The process 600 begins at step 601 in which a first weight is provided by forming a first intermediate body having a first head and a first shaft associated with the first head. The process 600 continues to step 603 in which a first internal bore is formed by removing a first mass from the first intermediate body. This material removal process, in some embodiments, includes a milling process. In other embodiments, the material removal process includes a drilling process or the like. Then, in step 605, a first external threaded surface is formed on the first shaft.

Next, in step 607, a second weight is provided by forming a second intermediate body having a second head and a second shaft associated with the second head. The process 600 continues to step 609 in which a second internal bore is formed by removing a second mass from the second intermediate body, the second mass being different from the first mass. This material removal process, in some embodiments, includes a milling process. In other embodiments, the material removal process includes a drilling process or the like. Then, in step 611, a second external threaded surface is formed on the second shaft. In some embodiments, additional processes are added. For example, any of the first and second weight members may undergo forging, work hardening, heat-treating, coating, plating, anodizing, media-blasting, painting, peening, laser-peening, and/or chemical etching processes. Further, in some embodiments, the relative order of processes discussed above varies. For example, in some embodiments, the second weight member is provided prior to the first weight member. Similarly, in some embodiments, for either or both process of providing the first weight member and providing the second weight member, the step of forming an external thread occurs prior to the step of forming a bore.

Those skilled in the art will appreciate that while the present invention has been described in association with presently preferred aspects thereof, numerous changes, modifications and substitutions of equivalents may be made therein without departing from the spirit and scope of this invention which is intended to be unlimited by the foregoing except as may appear in the following appended claims.

What is claimed is:

1. A method comprising:

forming a first weight having a first finished mass and a second weight having a second finished mass that is different than the first finished mass, thereby defining a variation in finished mass, by:

(a) forming a first intermediate weight body having a first head, including a first head end, and a first shaft, including a first shaft end opposite the first head end, and a first shaft outer diameter the first shaft comprising a first shaft length;

(b) forming a second intermediate weight body having a second head, including a second head end, and a second shaft, including a second shaft end opposite the second head end, and a second shaft outer diameter that is substantially equal to the first shaft outer diameter;

(c) removing an amount of mass from the first intermediate body to form an internal bore extending inwardly through the first intermediate body from the first head end, resulting in a non-zero variation in mass between the first intermediate body and the second intermediate body at least partially contributing to the variation in finished mass, the internal bore comprising a bore depth that is greater than the first shaft length; and (d) configuring the first and second intermediate weight bodies for interchangeable association within a weight port of a golf club head.

2. The method of claim 1, wherein the first weight further comprises a first shaft length and the second weight further comprises a second shaft length that is substantially equal to the first shaft length.

3. The method of claim 1, wherein the first weight further comprises a first head height and the second weight further comprises a second head height that is substantially equal to the first head height.

4. The method of claim 1, further comprising forming an external threaded surface on at least one of the first shaft of the first intermediate weight body or the second shaft of the second intermediate weight body.

5. The method of claim 1, wherein the first finished mass and the second finished mass differ by at least 1 g.

6. The method of claim 5, wherein the first finished mass and the second finished mass differ by at least 3 g.

7. The method of claim 1, wherein the internal bore is non-threaded.

8. The method of claim 1, wherein the first finished weight has a first overall length no less than 10 mm, and the second finished weight has a second overall length no less than 10 mm.

9. The method of claim 1, wherein at least one of the first finished weight and the second weight comprises more than one material.

10. A method comprising:

forming a first weight having a first finished mass and a second weight having a second finished mass that is different than the first finished mass, thereby defining a variation in finished mass, by:

(a) forming a first intermediate weight body having a first head, including a first head end, and a first shaft, including a first shaft end opposite the first head end, and a first shaft outer diameter, the first shaft comprising a first shaft length;

(b) forming a second intermediate weight body having a second head, including a second head end, and a second shaft, including a second shaft end opposite the second head end, and a second shaft outer diameter that is substantially equal to the first shaft outer diameter, the second shaft comprising a second shaft length;

(c) removing a first amount of mass from the first intermediate body to form a first internal bore extending inwardly through the first intermediate body from the first head end, the first internal bore comprising a first bore depth that is greater than the first shaft length;

(d) removing a second amount of mass from the second intermediate body to form a second internal bore extending inwardly through the second intermediate body from the second head end, the second amount of mass being different from the first amount of mass, thereby at least partially contributing to the variation in finished mass, the second internal bore comprising a second bore depth that is greater than the second shaft length; and (e) configuring the first and second intermediate weight bodies for interchangeable association within a weight port of a golf club head.

11. The method of claim 10, wherein:

the first internal bore comprises a first diameter; and the second internal bore comprises a second diameter that is different from the first diameter of the first internal bore.

12. The method of claim 10, wherein:

the first internal bore comprises a first bore depth; and the second internal bore comprises a second bore depth, such that an absolute difference between the first bore depth and the second bore depth is no less than 0.5 mm.

13. The method of claim 10, wherein the first weight further comprises a first shaft length and the second weight further comprises a second shaft length that is substantially equal to the first shaft length.

14. The method of claim 10, further comprising forming an external threaded surface on at least one of the first shaft of the first intermediate weight body or the second shaft of the second intermediate weight body.

15. The method of claim 10, wherein the first finished mass and the second finished mass differ by at least 3 g.

16. The method of claim 10, wherein the internal bore is non-threaded.

17. The method of claim 10, wherein at least one of the first finished weight and the second weight comprises more than one material.

* * * * *